US005673549A

United States Patent [19]

McNeill

[11] Patent Number: 5,673,549

[45] Date of Patent: Oct. 7, 1997

[54] METHOD AND APPARATUS FOR PRODUCING RANDOMLY VARIEGATED MULTIPLE STRAND TWISTED YARN AND YARN AND FABRIC MADE BY SAID METHOD

[75] Inventor: William A. McNeill, Gastonia, N.C.

[73] Assignee: Caress Yarns, Inc., Charlotte, N.C.

[21] Appl. No.: 599,801

[22] Filed: Feb. 12, 1996

Related U.S. Application Data

[63] Continuation-in-part of Ser. No. 297,252, Aug. 26, 1994, Pat. No. 5,619,849.

[51] Int. Cl.[6] ..... D01H 1/24; D01H 7/46

[52] U.S. Cl. ..... 57/333; 28/252; 57/81; 57/283; 57/293; 57/328; 57/350; 57/908

[58] Field of Search ..... 57/328, 204, 205, 57/206, 208, 283, 293, 78, 350, 333, 81, 79, 95, 98, 99, 908; 28/252

[56] References Cited

U.S. PATENT DOCUMENTS

| | | | |
|---|---|---|---|
| Re. 31,808 | 1/1985 | London, Jr. et al. | 57/6 |
| 3,748,648 | 7/1973 | Pugh | 340/172.5 |
| 4,083,172 | 4/1978 | Norris et al. | 57/34 |
| 4,164,836 | 8/1979 | Tanae et al. | 57/2 |
| 4,169,350 | 10/1979 | Yamana et al. | 57/350 |
| 4,206,589 | 6/1980 | Markey et al. | 57/293 |
| 4,212,152 | 7/1980 | Roman | 57/207 |
| 4,218,869 | 8/1980 | Newton | 57/245 |
| 4,223,520 | 9/1980 | Whitted et al. | 57/350 |
| 4,472,931 | 9/1984 | Stahlecker | 57/18 |
| 4,484,433 | 11/1984 | Stahlecker et al. | 57/15 |
| 4,484,435 | 11/1984 | Fritjof | 57/315 |
| 4,495,758 | 1/1985 | Stahlecker et al. | 57/16 |
| 4,569,192 | 2/1986 | Yamada et al. | 57/317 |
| 4,581,886 | 4/1986 | Coll-Tortosa | 57/333 |
| 4,610,131 | 9/1986 | Eschenbach et al. | 57/6 |
| 4,698,956 | 10/1987 | Clarke et al. | 57/2 |
| 4,807,431 | 2/1989 | Braxmeier | 57/333 |
| 4,934,134 | 6/1990 | Niederer | 57/350 |
| 4,945,718 | 8/1990 | Stahlecker et al. | 57/333 |
| 4,961,308 | 10/1990 | Braxmeier | 57/328 |
| 4,993,218 | 2/1991 | Schwartz et al. | 57/208 |
| 5,048,281 | 9/1991 | Dallmann et al. | 57/264 |
| 5,056,200 | 10/1991 | Schwartz et al. | 28/258 |
| 5,119,623 | 6/1992 | Fetzer et al. | 57/333 |
| 5,348,238 | 9/1994 | Yamauchi et al. | 242/18 R |

FOREIGN PATENT DOCUMENTS

| | | | |
|---|---|---|---|
| 2-23610 | 3/1982 | Japan | 57/283 |

*Primary Examiner*—William Stryjewski
*Attorney, Agent, or Firm*—Shefte, Pinckney & Sawyer

[57] ABSTRACT

A method and apparatus for producing randomly variegated multiple strand wrapped yarn in twisting together two or more yarns at a plurality of yarn twisting stations. At each station a pneumatic twisting head is disposed in which randomly turbulent air currents are created in a chamber in the twisting head by compressed air flowing into the chamber from a manifold through bores in the twisting head, thereby randomly twisting together two or more yarns in the chamber. The yarns which have been twisted together are wrapped with a binder yarn and then taken up over a plurality of traversing drums commonly mounted on a shaft which is driven by an alternating electric current motor controlled by a control device which operates to start and restart the motor on a predetermined cycle including a variation of the electrical input sufficient to result in randomly unpredictable inertia resistance of the traversing drums to rotational speed variation, thereby creating randomly unpredictable take-up of the yarns to produce non-uniform random twist in the yarns. The yarn produced has various lengths of opposite twist with varying degrees of twist and sections of no twist and sections of varying wrap, and the fabric produced with the yarn is randomly variegated with no repeating pattern.

17 Claims, 8 Drawing Sheets

METHOD AND APPARATUS FOR PRODUCING RANDOMLY VARIEGATED MULTIPLE STRAND TWISTED YARN AND YARN AND FABRIC MADE BY SAID METHOD

This is a continuation-in-part of U.S. patent application Ser. No. 08/297,252, filed Aug. 26, 1994, now U.S. Pat. No. 5,619,849, for METHOD AND APPARATUS FOR PRODUCING RANDOMLY VARIEGATED MULTIPLE STRAND YARN AND YARN AND FABRIC MADE BY SAID METHOD.

BACKGROUND OF THE INVENTION

The present invention relates to a method and apparatus for creating randomly variegated twisted yarn by twisting two or more yarns together, thereby preventing the development of patterning when the resulting yarn is used in textile products.

In the textile industry, two or more yarns are frequently twisted together into a single multi-ply yarn which has desirable characteristics such as improved strength, appearance, texture, wear resistance, ease of handling during manufacturing, or other properties. The yarn plies which are combined may be made up of different fibers, either natural or synthetic, or the yarns may be made up of the same type fiber but have slightly different qualities, even when unintended. The different yarn plies often have varying dye characteristics, and, if package dyeing of the combined yarn or piece dyeing is later employed, the yarn plies may attain visibly different color shades, giving the resulting product a variegated appearance. A variegated appearance may also arise from the differing texture or other properties of the individual yarn plies.

While a variegated appearance may be desirable in itself yarn patterning tends to arise when yarn plies are combined, producing streaks or other patterns which repeat throughout the textile product in which the combined yarn is used. Yarn patterning is caused by the tendency of the yarn plies to interact with mechanical parts, such as feed rollers and traversing drums, in a uniform repeating pattern, which has been difficult to avoid.

U.S. Pat. No. 4,934,134 to Niederer describes one approach to controlling yarn patterning in which a vortex is employed to randomly twist strands together with varying air pressure controlled by an air controller and a beater interposed in the path of the yarn to randomize the yarn strands. This approach requires an air controller and a mechanical beater which likely results in some ultimate repeating pattern. Further, the Niederer patent does not suggest varying the rate of take-up of the yarn as a means for varying the twist in the plied yarn.

For some purposes it is desirable to provide a yarn that has been wrapped with a binder yarn. Such wrapping, among other things, serves to increase the strength of the resulting yarn. Yarn wrapping machines are described in U.S. Pat. No. 4,472,931 to Stahlecker, U.S. Pat. No. 4,495,758 to Stahlecker et al, U.S. Pat. No. 4,484,435 to Fritjof, and U.S. Pat. No. 4,484,433 to Stahlecker et al.

In accordance with the present invention, a method and apparatus for creating randomly variegated twisted yarn is provided, in which the problem of yarn patterning is eliminated in a simple and efficient manner. The present invention includes twisting by use of a twisting head or by use of a wrapping device or both.

SUMMARY OF THE INVENTION

Briefly summarized, the present invention provides an improved method and apparatus for producing randomly variegated multiple strand yarn. According to one aspect of the method of the present invention, compressed air is delivered through spaced inlets to a supply conduit, thereby creating random air turbulence within the supply conduit, and this randomly turbulent air is supplied from the supply conduit to a chamber in a pneumatic twisting head. At least two yarns are continuously fed into the chamber, where they are randomly twisted together by the randomly turbulent air in the chamber. Preferably, the yarns are advanced through the pneumatic twisting head in an advancing direction, and the chamber has a cylindrical side wall with its axis substantially parallel to the direction in which the yarn is advanced, with air being delivered into the chamber through at least one bore which extends through the cylindrical side wall of the chamber in a generally tangential orientation. The outlet from the supply conduit is preferably located intermediate the spaced inlets to the supply conduit. Advantageously, there are a plurality of yarn twisting stations and the supply conduit is a manifold with a plurality of outlets, each outlet delivering air to one yarn twisting station.

According to a second aspect of the method of the present invention, randomly variegated multiple strand yarn is produced at a yarn twisting station where at least two yarns are continuously fed through a twisting head, the yarns are taken up from the twisting head over a traversing drum to form a yarn package, the traversing drum is rotated by driving it with an electric motor powered by alternating electric current, and the electrical input to the motor is varied according to a predetermined cycle which varies so as to create randomly unpredictable inertial resistance of the traversing drum to rotational speed variation, thereby creating randomly unpredictable take-up of the yarns. Preferably, there are a plurality of yarn twisting stations, each station having a traversing drum, and the traversing drums are mounted on a common shaft driven by the electric motor. The varying of the electrical input to the electric motor is preferably a stopping and restarting of the electric motor, and the dwell between stopping and restarting of the electric motor is preferably not sufficient to allow the traversing drum to come to a complete rotational stop.

According to yet another aspect of the method of the present invention, the yarn is wrapped with a binder yarn. The binder yarn is drawn from a rotating hollow spindle to wrap and twist the yarn as the yarn travels into and through the hollow spindle. This aspect of the method of the present invention is combined with either or both of the previously discussed aspects to result in a randomly variegated multiple strand wrapped yarn.

In the preferred embodiment of the method of the present invention, the aspect by which randomly turbulent air is delivered to the chamber and the aspect by which the traversing drum takes up the yarn in a randomly unpredictable manner are combined, along with the step of wrapping the yarn and the other additional features described above.

According to one aspect of the apparatus of the present invention, a supply conduit has spaced inlets into which compressed air is supplied so as to create random air turbulence in the supply conduit, the supply conduit has an outlet through which randomly turbulent air is delivered to a chamber in a pneumatic twisting head while a feeding device continuously feeds at least two yarns into the chamber, and the yarns are randomly twisted together in the chamber by the randomly turbulent air, after which take-up means act to take up the randomly twisted yarns to form a yarn package. Preferably, the feeding means, take-up means, and compressed air combine to advance the yarns through the pneumatic twisting head in an advancing direction, and the chamber has a cylindrical side wall with its axis substantially parallel to the direction in which the yarn advances, with randomly turbulent air being supplied to the chamber through at least one bore in the cylindrical side wall of the chamber, the bore being generally tangentially oriented to the side wall of the chamber. The supply conduit's outlet to the chamber is preferably located intermediate the spaced inlets to the supply conduit. There are preferably a plurality of yarn twisting stations and the supply conduit is a manifold which has a plurality of outlets, with each outlet supplying compressed air to one of the yarn twisting stations.

According to a second aspect of the apparatus of the present invention, feeding means at a yarn twisting station continuously feed at least two yarns through a twisting head, take-up means operate to take up the yarns over a traversing drum to form a yarn package, an electric motor powered by alternating electric current rotatingly drives the traversing drum, and a control device varies the electrical input to the motor according to a predetermined cycle which includes a variation of the electrical input to the motor sufficient to result in randomly unpredictable inertial resistance of the traversing drum to variation of its rotational speed, thereby creating randomly unpredictable take-up of the yarns. Preferably, there are a plurality of yarn twisting stations with a plurality of traversing drums, each drum being located at one of the stations, and the electric motor commonly drives the drums. Preferably, the traversing drums are mounted on a common shaft driven by the electric motor, while the control means operates to stop and restart the electric motor, and there is not sufficient dwell between the stopping and restarting of the motor to allow the traversing drum to come to a complete rotational stop. The control means preferably includes a cam-actuated switch with a motor for driving the cam.

According to another aspect of the apparatus of the present invention, each yarn twisting station has a means for wrapping the randomly variegated multiple strand yarn. Preferably, this means comprises at least one hollow spindle, through which the yarn is fed. The hollow spindle is rotated by a driving means, and the binder yarn on the hollow spindle is wrapped around the yarn as the yarn travels into and through the hollow spindle. This aspect is combined with either or both of the previously discussed aspects of the apparatus of the present invention to result in a randomly variegated multiple strand wrapped yarn.

In the preferred embodiment of the apparatus of the present invention, the aspect by which randomly turbulent air randomly twists together the yarns in the chamber and the aspect by which the traversing drum randomly takes up the yarns are combined, along with the aspect by which the yarn is wrapped and the other additional features of the apparatus of the present invention described above.

Accordingly, the present invention provides a simple and efficient apparatus and method for producing randomly variegated multiple strand twisted yarn.

The present invention will be described in further detail below in terms of the preferred embodiment of the apparatus for producing randomly variegated multiple strand twisted yarn and the method practice using the apparatus.

DESCRIPTION OF THE PREFERRED EMBODIMENT

Figure 1:
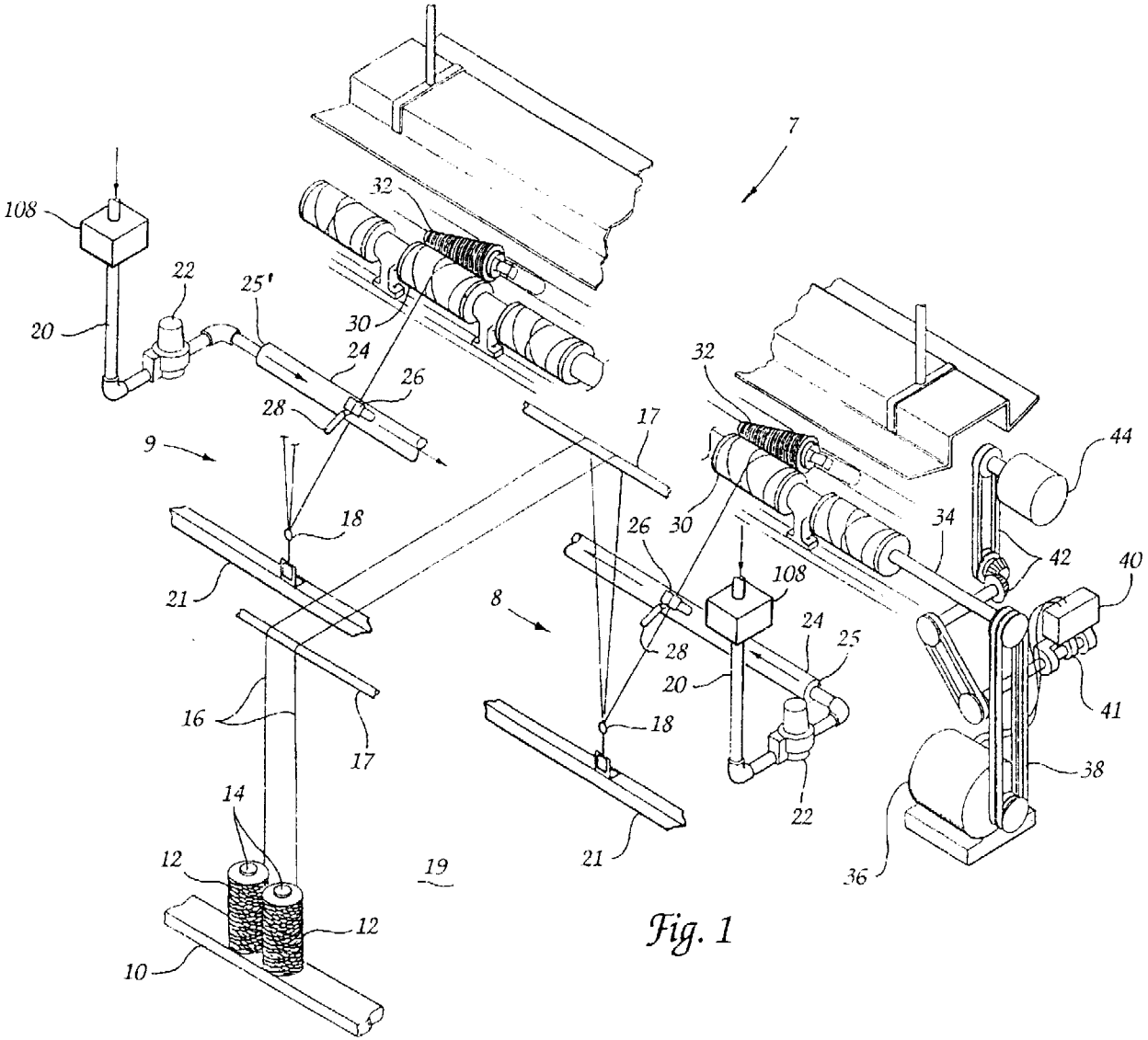
FIG. 1 is a perspective view of multiple yarn twisting stations embodying the preferred embodiment of the present invention.
Figure 2:
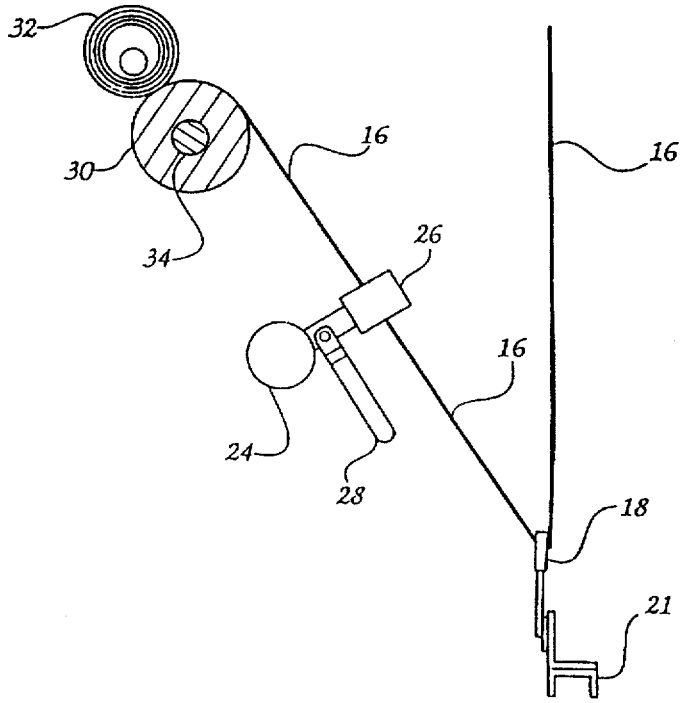
FIG. 2 is an enlarged vertical sectional view of a portion of one of the yarn twisting stations of FIG. 1.
Figure 3:
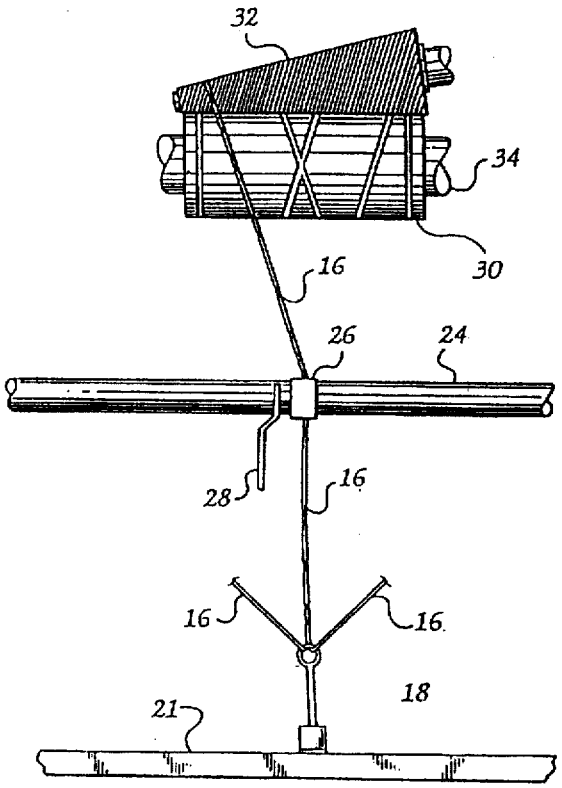
FIG. 3 is an enlarged front elevational view of a portion of the yarn twisting station illustrated in FIG. 2.

Referring now to the accompanying drawings, in FIG. 1 a yarn twisting station 8 is illustrated, along with a partial view of another yarn twisting station 9, with stations 8,9, along with a plurality of identically configured yarn twisting stations (not shown) making up a yarn twisting frame 7. Yarn twisting frame 7 includes a pair of spaced parallel lines of yarn twisting stations, one line on each side of the frame, only one line being shown. The yarn twisting stations on each side of the yarn twisting frame 7 are arranged in an in-line orientation, as shown in FIG. 1. Each yarn twisting station 8,9 is operable to twist together yarn from a plurality of yarn supply packages and wind the twisted yarn into a yarn package, and each yarn twisting station incorporates the apparatus of the present invention for randomly twisting together the yarns from the separate yarn supply packages.

At the yarn twisting station 8, yarn supply packages 12 are supported for unwinding on spindles 14 at a creel 10. The yarns 16 from the supply packages 12 are fed into the yarn twisting station 8 over spaced upper guide bars 17, thereby forming a passageway 19 thereunder through which service personnel may easily access the components of the yarn twisting station 8. The yarns 16 are then fed through eyelet 18 mounted on mounting bar 21 and from there into a pneumatic twisting head 26.

The pneumatic twisting head 26 is mounted on a manifold 24 that extends longitudinally along the extent of the twisting frame 7 and has opposed ends 25,25' beyond the first and last twisting stations on one side of the frame 7. Each twisting head 26 communicates with the interior of the manifold 24 in a manner which will be described in detail below. The manifold 24 is supplied with compressed air through its two opposed ends 25,25' by supply piping 20. Regulators 22 assist in controlling the feed of compressed air to the manifold 24. In one embodiment, the air supply is provided with a programmable timer 108, such that air pulses to the manifold 24 are staggered. Such timer 108 alternately stops the flow of air into each end 25 of the manifold 24. Such staggered bursts of air contribute to the randomly changing dynamics of the air turbulence in the manifold 24.

Figure 4:
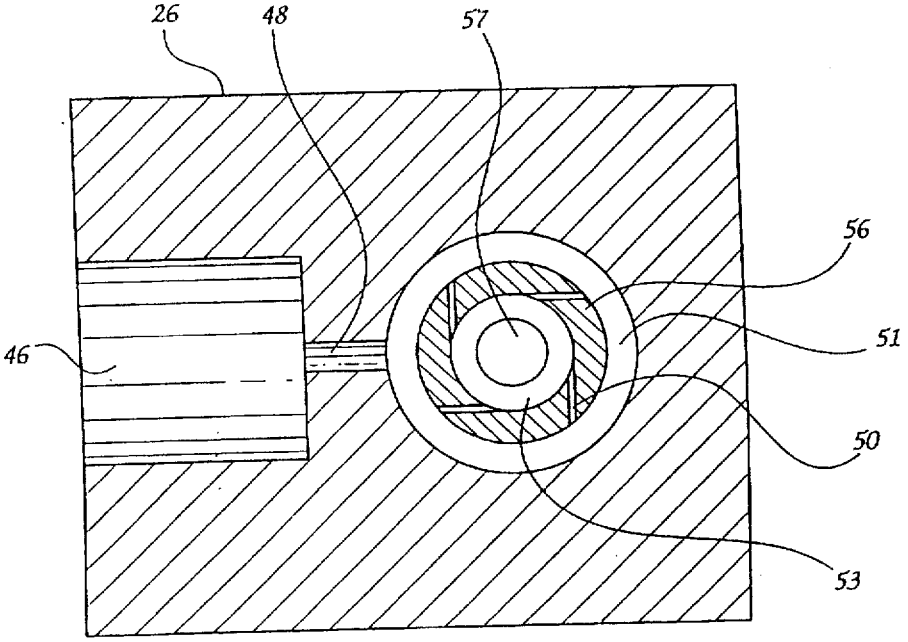
FIG. 4 is an enlarged transverse sectional view of a pneumatic twisting head included in the apparatus of FIG. 1 as viewed along line 4—4 in FIG. 5.
Figure 4A:
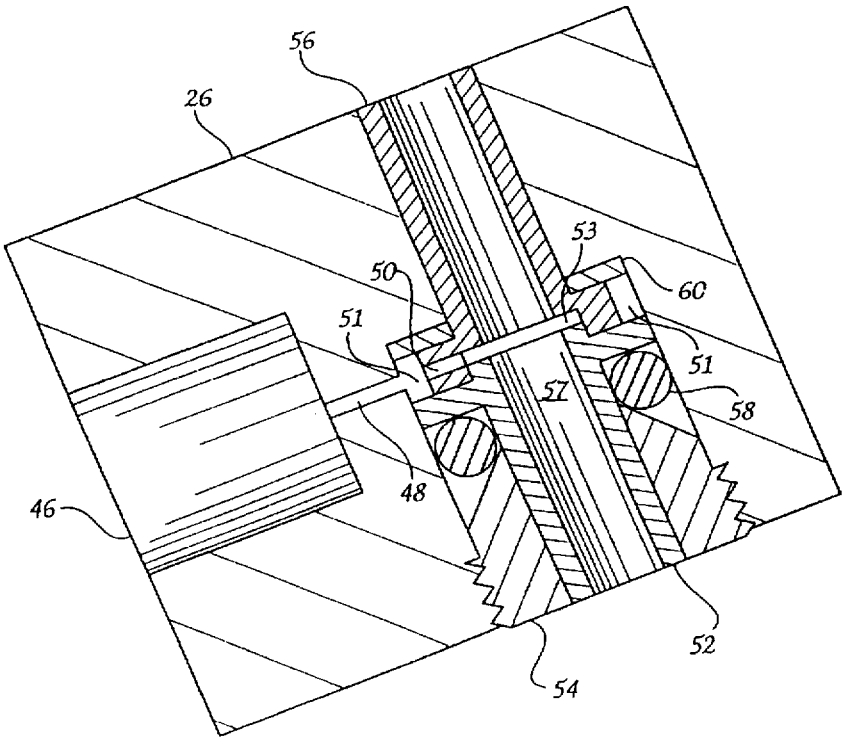
FIG. 4A is an enlarged generally longitudinal sectional view of a pneumatic twisting head included in the apparatus of FIG. 1 as viewed along line 4A—4A in FIG. 5, with the section taken so as to illustrate the full length of one of the inlet bores in the twisting head.

Turning now to FIGS. 4 and 4A, the construction of the pneumatic twisting head 26 can be seen in detail. Yarns 16 (not shown) enter the pneumatic twisting head 26 through an input sleeve 52, which is partially secured by a threaded cap 54 and an O-ring seal 58. The yarns advance through the pneumatic twisting head 26 in a yarn advancing direction. The yarns 16 (not shown) then exit the pneumatic twisting head 26 through an output sleeve 56, which is secured in place by the flange of the input sleeve 52, a sealing washer 60, and the construction of the pneumatic twisting head 26. Together, the input sleeve 52 and output sleeve 56 form a chamber 57 having a cylindrical side wall with its axis substantially parallel to the yarn advancing direction.

Compressed air from the manifold 24 enters the supply plenum 46 of the pneumatic twisting head 26, which then leads the compressed air into a supply passage 48, through which the compressed air flows into an outer annular space 51, which surrounds the flanged portion of the output sleeve 56. From the outer annular space 51, the compressed air then enters an inlet bore 50, from which it passes into an inner annular space 53, which communicates with the cylindrical chamber 57 formed by the input sleeve 52 and the output sleeve 56. The inlet bore 50 is disposed in a generally tangential relation to the chamber 57 of the pneumatic twisting head 26. In the illustrated embodiment, four inlet bores 50, which are circumferentially spaced from each other, communicate between the annular space 51 and the chamber 57 of the pneumatic twisting head 26.

Figure 5:
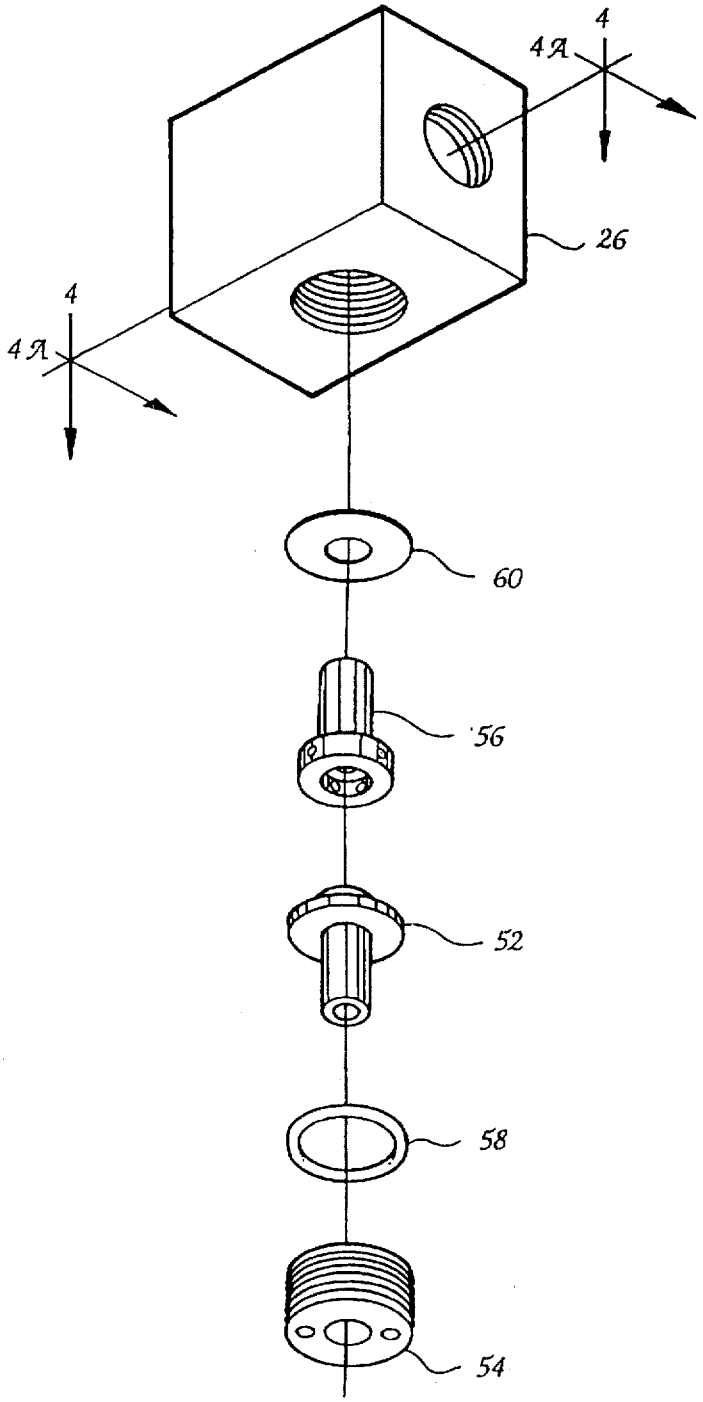
FIG. 5 is an exploded perspective view of the pneumatic twisting head of one of the twisting stations of FIG. 1.

The assembly of the items making up the pneumatic twisting head 26 is also shown in FIG. 5 in an exploded view.

Returning to FIG. 1, a shut-off valve 28 is located between the manifold 24 and the pneumatic twisting head 26 so that the compressed air supply may be shut off when necessary, for example, during doffing of a yarn package, threading of new yarns, or rethreading after a yarn break. Yarn 16 leaving the pneumatic twisting head 26 is taken up over a traversing drum 30 onto a take-up package 32. The traversing drum 30 and the mechanism (not shown) supporting yarn take-up package 32 are also conventional. The yarn take-up package 32 may be doffed, in a conventional manner, when its yarn capacity has been reached.

In a preferred embodiment, there is a means for wrapping the yarns interposed between twisting head 26 and traversing drum 30. The means for wrapping comprises at least one hollow spindle 100, with a binder yarn 102 wound around the outer circumference of the hollow spindle 100. The hollow spindle 100 is rotated at a constant speed by a drive means, such as a continuous loop belt 106. Preferably, all hollow spindles 100 on a multiple station machine are driven by the same continuous loop belt 106. The binder yarn 102 is wrapped on the twisted yarns 16 by the rotating motion of the hollow spindle 100 as the yarns 16 travel into and through the interior of the hollow spindle 100. The yarns 16 are drawn through the interior of the hollow spindle 100 after first contacting binder yarn 102. A guide bar 104 is provided to guide the wrapped yarns 16 to the traversing drum 30 after passing through the interior of hollow spindle 100.

Conventional wrapped yarn machines utilizing hollow spindles, such as that in Stahlecker et al '758, comprise feed and take-up rollers upstream and downstream of the hollow spindle. These rollers serve to keep the yarn tensioned as it is drawn through the interior of the hollow spindle. These rollers assist in the control of the yarns passing through the hollow spindle and aid in maintaining uniformity of the travel of the yarns. The present invention, however, dispenses with these rollers that are required by the conventional machines. Elimination of these rollers allows the yarn 16 to further twist as it enters and passes through the interior of the hollow spindle 100 and is wrapped by the binder yarn 102.

Figure 9:
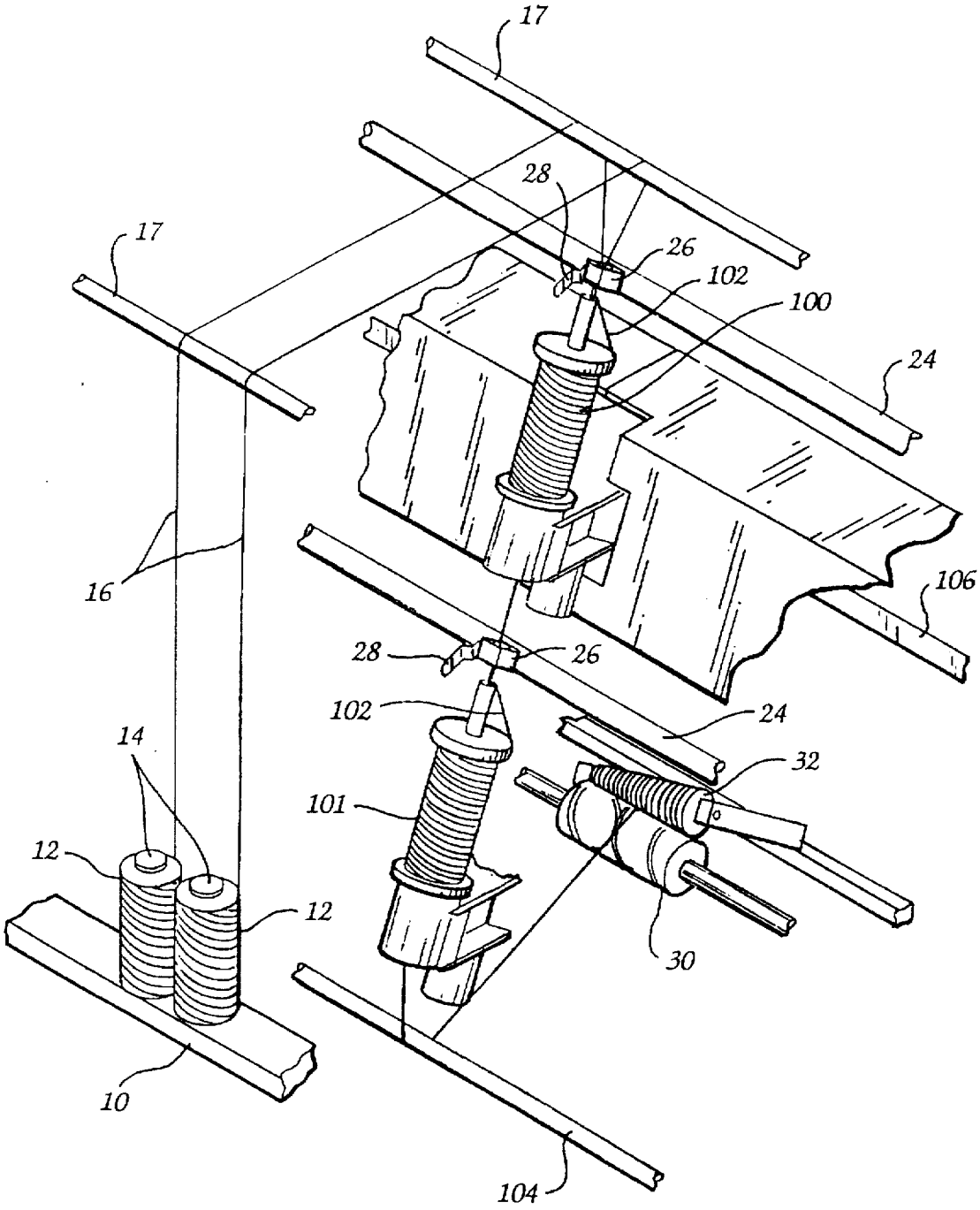
FIG. 9 is a perspective view of a yarn twisting station embodying the preferred embodiment of the present invention including the wrapping means.
Figure 10:
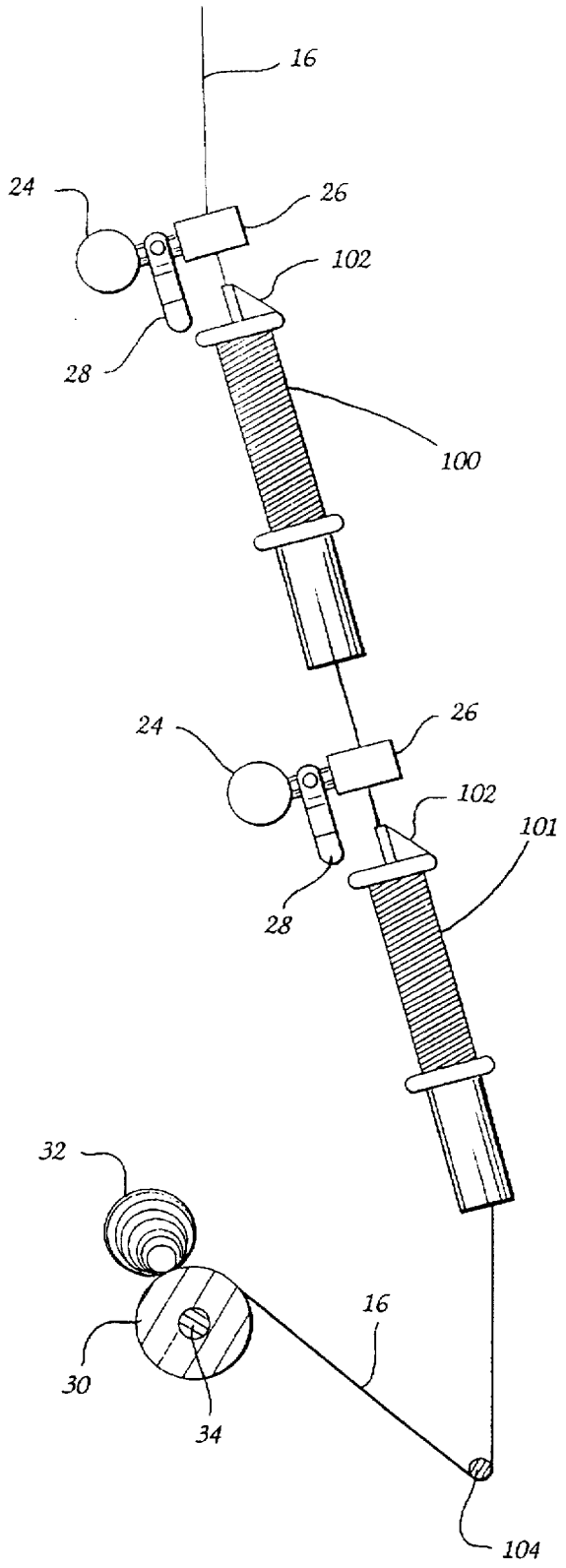
FIG. 10 is a vertical sectional view of a portion of the yarn twisting station of FIG. 9.

In a more preferred embodiment, another twisting head 26 and a second hollow spindle 101 are disposed between the first hollow spindle 100 and the traversing drum 30. The yarns 16 pass sequentially through the other twisting head 26 and the second hollow spindle 101. In this way, a faster yarn take-up speed may be achieved. Also, each hollow spindle 100,101 may be rotated in a different direction; thus, each hollow spindle 100,101 may impart a different twist (either S or Z) than the other hollow spindle 100,101, further adding to the randomness of the twist. Such configuration is illustrated in FIGS. 9 and 10.

The traversing drum 30 is mounted on a shaft 34, which serves as a common shaft on which all traversing drums at all the stations on one side of the frame are commonly mounted. Shaft 34 is driven by an alternating electric current motor 36 through drive belts 38. The input of alternating electric current to the motor 36 is controlled by a control device 40, which varies the electrical input on a predetermined cycle governed by a cam actuated switch 65 actuated by a control cam 41, which is mounted on a shaft 63 driven by an alternating electric current control motor 44 through cam drive belts and gears 42.

Figure 6:
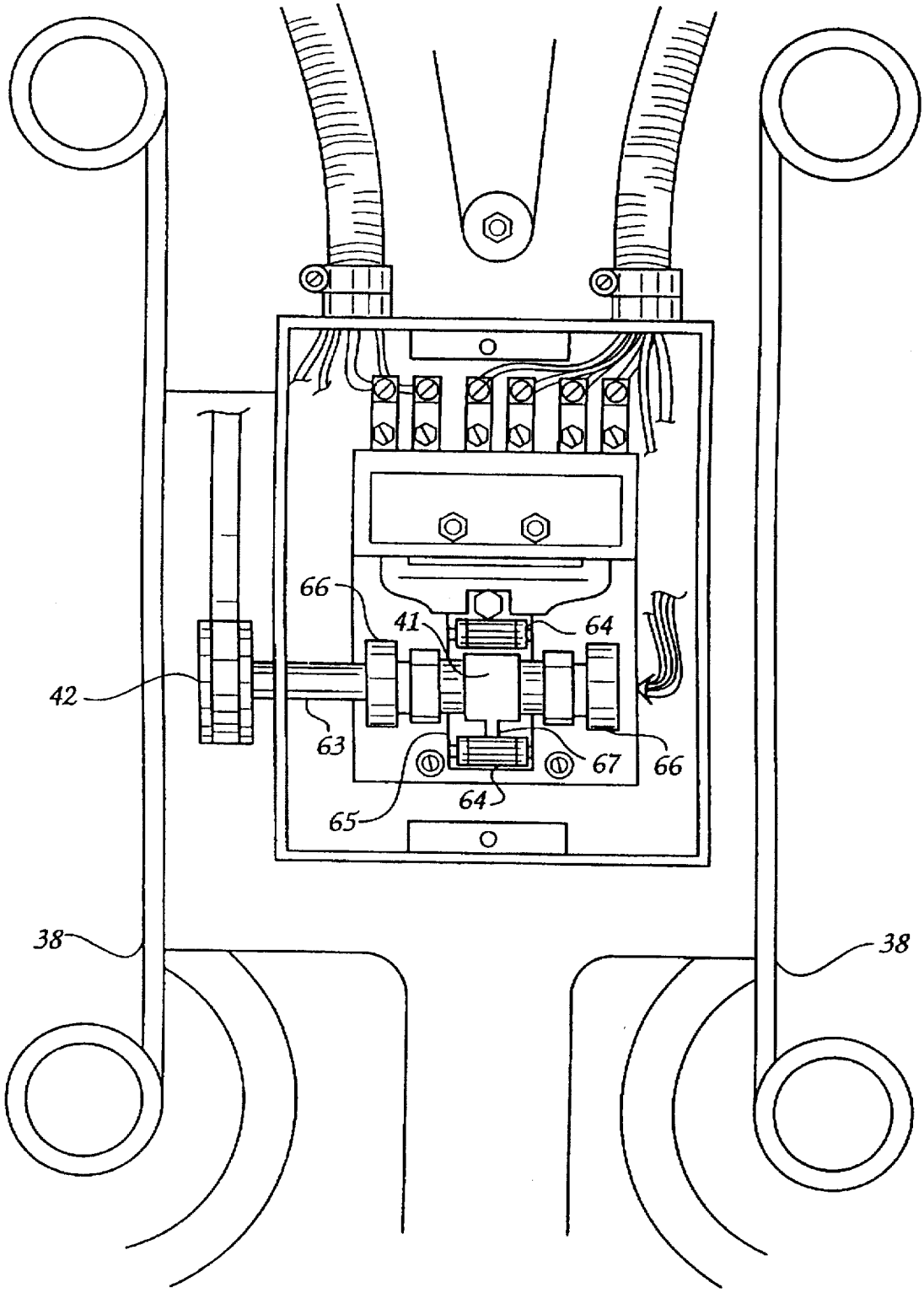
FIG. 6 is an enlarged elevational view of a cam-actuating switch mechanism for controlling the take-up of yarn in the apparatus FIG. 1.

The details of the control device 40 are more clearly seen in FIG. 6. The control cam 41 rotates with a shaft 63, which is secured by bearings 66. As the cam 41 rotates, a lobe 67 on the cam 41 alternately contacts two opposed followers 64 and displaces them to alternately actuate and deactuate the switch 65 to alternately shut off and open the input connection of alternating electric current to the alternating electric current motor 36, depending upon which of the followers 64 is displaced by the cam 41. The predetermined cycle of shutting off and opening the input connection of alternating electric current to the motor 36 is configured so that the resulting stopping and restarting of the motor 36 allows the traversing drums 30 to maintain sufficient inertial force so that the drums 30 do not come to a complete rotational stop during the cycle. It should be understood that the control device 40 could take the form of an electronic device or any other suitable control arrangement.

In operation, compressed air supplied to the manifold 24 through the supply piping 20 enters the manifold 24 at its opposite ends 25,25', with the oppositely directed air interacting to create a swirling random air turbulence throughout the manifold 24. Yarns 16 drawn from the separate yarn supply packages 12 enter the pneumatic twisting head 26 and are fed into the chamber 57 formed by the input sleeve 52 and output sleeve 56. Randomly turbulent air from the manifold 24 enters the pneumatic twisting head 26 through the supply plenum 46, flows into the supply passage 48, the outer annular space 51, and inlet bores 50, and from there enters the inner annular space 53 and the cylindrical chamber 57 of the pneumatic twisting head 26, thereby creating randomly turbulent air currents in the chamber for randomly twisting together the yarns 16. The random air turbulence in the manifold 24 is further enhanced when one of the valves 28 is engaged to cut off air flow to one of the pneumatic twisting heads 26 mounted on the manifold 24 thereby changing the dynamics of air turbulence in the manifold 24. The valve 28 may be engaged during a rethreading operation following a yarn break or during doffing of a full yarn take-up package 32 and subsequent rethreading. Random air turbulence is further enhanced by utilization of a conventional programmable timer 108 in the air supply as discussed above.

Following the random twisting together of the yarns 16 in the pneumatic twisting head 26, the yarns 16 are wrapped with the binder yarn 102 before being passed through the interior of the hollow spindle 100. The binder yarn 102 on the rotating hollow spindle 100 wraps the yarns 16 as they enter and pass through the interior of hollow spindle 100. The randomly varying take-up speed of the yarn, discussed below, results in a random patternless wrapping of the yarns 16 by the binder tarn, the yarns 16 preferred embodiment, the yarns 16 that are wrapped by the binder yarn 102 are then passed through another pneumatic twisting head 26 and through a second rotating hollow spindle 101. The yarns 16 are further wrapped by another binder yarn 102 from the second rotating hollow spindle 101.

Following the wrapping of the yarns 16 in the hollow spindle 100, the yarns 16 are, as noted previously, taken up over the traversing drum 30. Control device 40 operates, as noted above, to alternately shut off and open the connection of alternating electric current to the alternating electric current motor 36 on a predetermined cycle governed by the cam actuated switch 65 actuated by the cam 41, which is powered by the alternating current electric control motor 44. In the preferred embodiment, the cam 41 in the control device 40 actuates cam actuated switch 65 to shut off and open the connection of alternating electric current to the motor fifty times per minute, it being understood that other predetermined cycles for the control device 40 may be employed so long as the traversing drum 30 is not allowed to come to a rotational stop during the operational cycle. The coasting action of the alternating electric current motor 36 which ensues once electric current to the motor 36 is shut off, and the varying inertial forces inherent in the traversing drums 30 result in the traversing drums 30 having a randomly unpredictable cumulative inertial resistance to variation of rotational speed, which therefore creates a randomly unpredictable take-up of yarns 16 on the traversing drum 30, which causes yarn 16 to lose the false twist imparted to it in the pneumatic twisting head 26 at a randomly unpredictable rate. It should be understood that randomly unpredictable take-up of the yarns 16 on a traversing drum 30 could be created by varying the electrical input to alternating electric current motor 36 without shutting off and starting the electrical input and that variation of the electrical input could be accomplished by varying the voltage, frequency, or any other suitable means.

Figure 7:
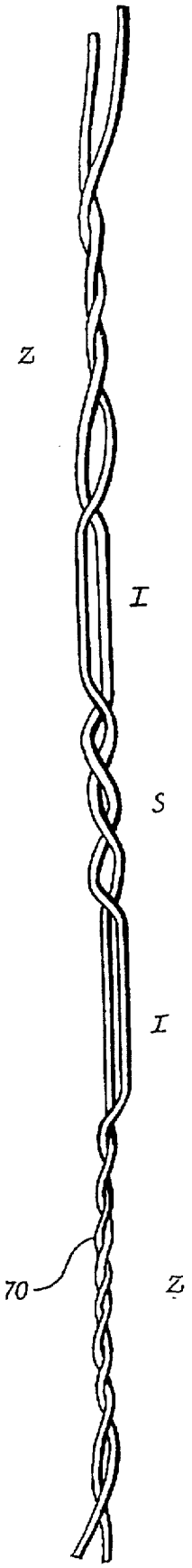
FIG. 7 is a view of randomly twisted yarn produced by a yarn twisting station embodying the present invention.

A length of typical randomly variegated multiple strand yarn produced by the method of the preferred embodiment of the present invention using the apparatus of the preferred embodiment of the present invention is seen in FIG. 7, in which the yarn 70 displays the randomly varying twist characteristic of yarns produced by the present invention. Reversal of the twist in the yarn, which changes from Z-twist to S-twist and then back to Z-twist again, can also be clearly seen in FIG. 7, and is additionally characteristic of yarn produced by the present invention. The reversal of twist occurs as yarn exits the pneumatic twisting head and begins to lose some of the false twist imparted to it in the twisting head. The amount of twist imparted to the yarn varies randomly along the length of the yarn, and more highly twisted sections, Z-twist sections indicated by the letter Z in FIG. 7, tend to untwist more rapidly and with greater force. This untwisting affects areas along the length of the yarn downstream from the untwisting sections up to the traversing drum and may cause sections which have been more loosely twisted to continue to "untwist" until they become reversely twisted, as indicated by the letter S in FIG. 7, in the reverse direction from the twist imparted by the twisting head with intermediate lengths, as indicated by the letter I in FIG. 7, being substantially without twist.

Figure 8:
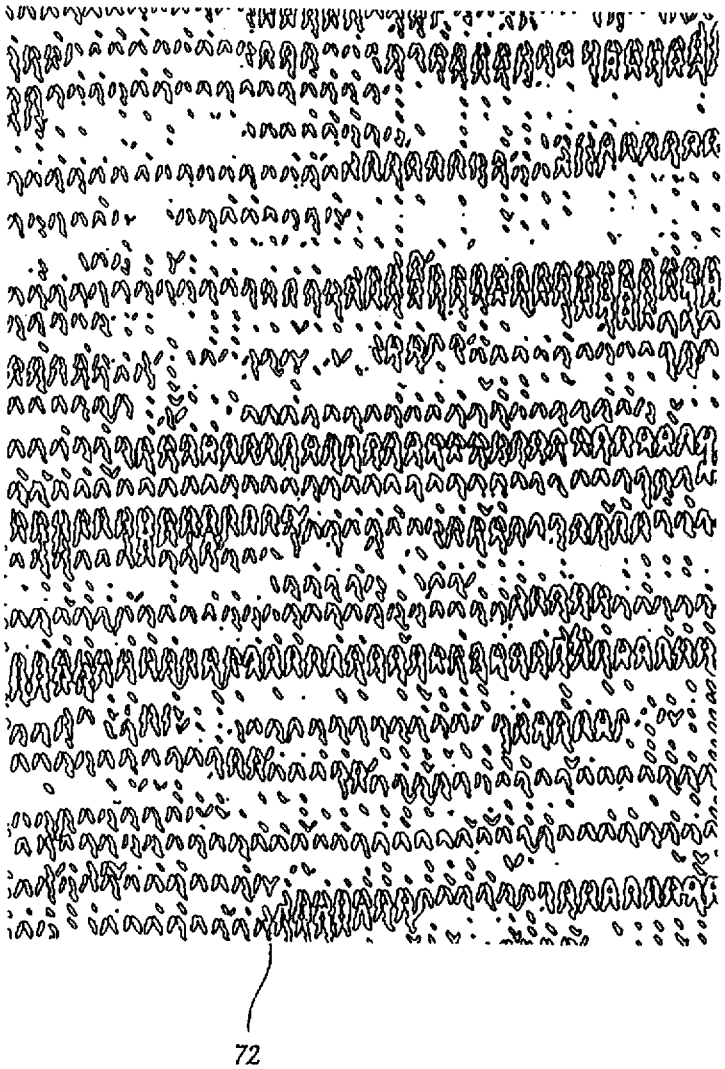
FIG. 8 is a view of a portion of knitted fabric composed of yarn produced by a yarn twisting station embodying the present invention.

In FIG. 8 is illustrated a sample of knitted cloth using yarns produced by the present invention. The randomly variegated appearance of the cloth 72 is characteristic of textile products produced by the present invention. Cloth 72 produced with yarn such as yarn 70 will also have a soft texture or hand as a result of the randomly varying twist on yarn 70, on which a significant number of areas will have a low number of twists per inch in either direction or no twist. When yarn 70 is knitted or woven into cloth, these areas of low or no twist along the yarn give the cloth a soft and yielding texture which is pleasing and desirable.

In FIG. 9 is illustrated the embodiment of the present invention wherein at least one rotating hollow spindle 100 is used to wrap the yarns 16 with a binder yarn 102. The use of two hollow spindles 100,101 provides adequate wrap cover of the twisted yarn at faster take-up speeds than when wrapping the yarn with one hollow spindle 100, thus increasing productivity. Further, each hollow spindle 100, 101 may be rotated in a different direction, such that the wrapping by the binder yarn from one hollow spindle 100,101 imparts an S-twist to the yarns 16 as they are wrapped, and the wrapping by the binder yarn from the other hollow spindle 100,101 imparts a Z-twist to the yarns 16 as they are wrapped. Thus, in combination, the randomness of the air turbulence in the manifold 24 and the varying of the speed of the take-up yarn over the traversing drum 30 creates an enhanced randomness in the wrap of the binder yarn 102 over the yarns 16. It is to be further noted that the use of at least one rotating hollow spindle 100 in conjunction with the varying of the speed of the traversing drum 30 is sufficient to impart a random twist to the yarns 16 as they are wrapped by the binder yarn 102. Such randomness also produces a randomly variegated multiple strand wrapped yarn, without the use of the pneumatic twisting head 26. It is to be noted that, without the use of the pneumatic twisting head 26, the twist is all in either the S or Z direction, the random S/Z-twists discussed above do not occur when the pneumatic twisting head 26 is not utilized. In the preferred embodiment, the pneumatic twisting head 26, the varying speed traversing drum 30, and the rotating hollow spindles 100,101 are used to create the randomly variegated multiple strand twisted and wrapped yarn.

The binder yarn 102 may be of any fiber, such as wool, or any continuous filament, such as polyester or selected from material known as metallics, or from other synthetic materials, such as polyethylene terephthalate, or Mylar®. In one embodiment, it is intended that the binder yarn 102 be relatively inconspicuous compared to the yarns 16. Thus, it is the yarns 16 that exhibit the desired aesthetic qualities, while binder yarn 102 imparts additional qualities such as strength and cohesiveness. In other embodiments, the binder yarn 102 may add to the aesthetic qualities, such as enhancing the color or the texture, and thus not be relatively inconspicuous.

The use of the present apparatus and method for producing randomly variegated multiple strand twisted and wrapped yarn and the yarn and fabric made by the method is particularly advantageous when the yarns 16 are cotton yarns and the binder yarn 102 is chosen to be a thread that can be heat set or melted. This enables one to create a randomly variegated multiple strand twisted and wrapped cotton yarn of more than one color that can be heat set or have the binder yarn 102 melted to promote the cohesiveness of the cotton fabric. The process of heat setting or melting of the binder yarn occurs after the wrapped twisted yarn 16 is taken up on the take-up package 32. In yet another embodiment, the binder yarn 102 is water soluble and will disappear after washing the article in which the yarns are ultimately placed.

It is to be recognized that the size of the yarns 16 or the binder yarn 102 is not limiting to the invention. With properly sized equipment, any size yarns 16 or binder yarn 102 can be accommodated. It is contemplated that the size of binder yarn 102 is either smaller, equal to, or larger than the size of yarns 16, depending upon the desired properties of the wrapped twisted yarn and the available materials.

One function of the binder yarn 102 is to bind the yarns 16 together. The binder yarn 102 may be of any size and may be permanent, such as to add color, or temporary, such as if water soluble or having a low melt point. The specific characteristics and properties of the binder yarn 102 are variable to accommodate the desired end use of the wrapped twisted yarn and the materials available for use as a binder yarn. Such flexibility is an advantageous characteristic of the present invention.

The unique method and apparatus of the present invention for producing randomly variegated multiple strand yarn has several advantages. In the yarn twisting station 8 of the present invention, the twisting together of yarns 16 is randomized by two aspects, the random turbulence of the compressed air introduced into the pneumatic twisting head 26 and the randomly unpredictable rotational speed of the traversing drum 30. These two aspects interact to completely randomize the twisting together of yarns 16 and operate in such a way that wear on the components of the system does not tend to reduce the randomizing action of the two aspects. The present invention's method and apparatus for random twisting together of yarn is of significant benefit to the textile industry in that it prevents the serious problem of yarn patterning from arising allowing textile products with a truly randomly variegated appearance to be produced, resulting in textile products with attractive and unique appearances and textures.

The amount of twist in the yarn taken up on the package 32 may be varied by adjusting the pressure of the compressed air delivered to the manifold 24, thereby resulting in a change in the average pressure of the air flowing into the chamber 57 through the bores 50 and consequently varying the turbulence of the air twisting the yarns 16 in the chamber 57. The amount of twist in the yarn taken up on the package 32 may also be adjusted by increasing or decreasing the operating speeds of the alternating electric current motor 36, which imparts greater or lesser speed to the traversing drums 30 through the shaft 34, and by increasing or decreasing the distance between the traversing drums 30 and pneumatic twisting heads 26.

Although the present invention has been illustrated herein with two yarn supply packages supplying yarn to the yarn twisting station 8, it should be understood that three or more yarn packages could be employed to supply yarn at each yarn twisting station. The chamber 57 in the pneumatic twisting head 26 can be made larger or smaller to accommodate greater or lesser numbers of yarn to be twisted together or to accommodate larger or smaller sized yarns.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for producing randomly variegated multiple strand twisted yarn in pneumatically twisting together two or more yarns at a yarn twisting station, comprising:

continuously feeding at least two yarns into a chamber in a pneumatic twisting head;

delivering compressed air to a supply conduit through spaced inlets to create random air turbulence within said supply conduit;

supplying said randomly turbulent air from said supply conduit through an outlet in said supply conduit said chamber for randomly twisting together the yarns in said chamber;

wrapping said twisted together yarn with a binder yarn; and taking up said yarns from the twisting head to form a yarn package.

2. A method for producing randomly variegated multiple strand twisted yarn in twisting together two or more yarns at a yarn twisting station, comprising:

continuously feeding at least two yarns through a twisting head;

twisting the at least two yarns in the twisting head;

wrapping said yarns with a binder yarn;

taking up the yarns from the twisting head over a traversing drum to form a yarn package;

rotating said traversing drum by driving it with an electric motor powered by alternating electric current; and varying the electrical input to said electric motor according to a predetermined cycle including a variation of said electrical input sufficient to result in randomly unpredictable inertial resistance of the traversing drum to rotational speed variation, thereby creating randomly unpredictable take up of said yarns to produce non-uniform random twist in said yarns.

3. A method for producing randomly variegated multiple strand yarn in pneumatically twisting together at least two yarns at a plurality of yarn twisting stations, comprising:

continuously feeding at least two yarns into a chamber in a plurality of pneumatic twisting heads, each yarn twisting station being one of said pneumatic twisting heads;

delivering compressed air to a manifold through spaced inlets so as to create random air turbulence within said manifold;

supplying said randomly turbulent air from said manifold through a plurality of outlets to said chambers for randomly twisting together the yarns therein, each said outlet communicating with one of said chambers, said outlets being disposed intermediate said spaced outlets;

wrapping the yarns with a binder yarn from a plurality of hollow spindles, at least one of said spindles being located at each of said yarn twisting stations;

taking up the yarns from said twisting heads over a plurality of traversing drums, each drum being at one of said yarn twisting stations and taking up yarn from one of said pneumatic twisting heads;

commonly driving said traversing drums by a shaft on which said traversing drums are commonly mounted, said shaft being driven by an electric motor powered by alternating electric current;

varying the electrical input to said electric motor according to a predetermined cycle including a variation of said electrical input sufficient to result in randomly unpredictable inertial resistance of the traversing drum to rotational speed variation, thereby creating randomly unpredictable take-up of said yarns to produce non-uniform random twist in said yarns.

4. A twisted at least two-ply yarn made by the method of claim 3.

5. A textile fabric made from at least two-ply yarn made by the method of claim 3.

6. An apparatus for producing randomly variegated multiple strand yarn in pneumatically twisting together at least two yarns at a yarn twisting station, comprising:

a pneumatic twisting head having a chamber therein;

means for continuously feeding at least two yarns into said chamber in said pneumatic twisting head;

a supply conduit having spaced inlets into which compressed air is delivered so as to create random air turbulence in said supply conduit, said supply conduit further having an outlet communicating with said chamber to supply said randomly turbulent air thereinto for randomly twisting together the yarns therein;

means for wrapping the yarns with a binder yarn; and means for taking up said randomly twisted yarns to form a yarn package.

7. The apparatus of claim 6, wherein the means for wrapping the yarns comprises at least one rotating hollow spindle on which the binder yarn is wound and through which the wrapped yarn is passed.

8. The apparatus of claim 7, wherein there are two rotating hollow spindles arranged in series, said spindles rotatable in opposite directions.

9. An apparatus for producing randomly variegated multiple strand yarn in twisting together two or more yarns at a yarn twisting station, comprising:

means for continuously feeding at least two yarns through a twisting head;

means for wrapping the yarns with a binder yarn;

means for taking up said yarns from said twisting head over a traversing drum to form a yarn package;

an electric motor powered by alternating electric current for rotatingly driving said traversing drum;

electrical input means for supplying said motor with alternating electric current; and control means for varying said electrical input current according to a predetermined cycle including a variation of said electrical input sufficient to result in randomly unpredictable inertial resistance of the traversing drum to rotational speed variation, thereby creating randomly unpredictable take up of said yarns to produce non-uniform random twist in said yarns.

10. The apparatus of claim 9, wherein the means for wrapping the yarns comprises at least one rotating hollow spindle on which the binder yarn is wound and through which the wrapped yarn is passed.

11. The apparatus of claim 10, wherein there are two rotating hollow spindles arranged in series, said spindles rotatable in opposite directions.

12. An apparatus for producing randomly variegated multiple strand yarn in pneumatically twisting together at least two yarns at a plurality of yarn twisting stations, comprising:

a pneumatic twisting head having a chamber therein, each yarn twisting station having one of said pneumatic twisting heads;

means for continuously feeding at least two yarns into each said chamber in each said pneumatic twisting head;

a manifold having spaced inlets into which compressed air is delivered so as to create random air turbulence in said manifold, said manifold further having a plurality of outlets intermediate said spaced inlets, each outlet communicating with one of said chambers to supply said randomly turbulent air thereinto for randomly twisting together the yarns therein;

a plurality of means for wrapping said yarns with a binder yarn, at least one of said wrapping means being located at each of said yarn twisting stations;

a plurality of traversing drums mounted on a common shaft, each said drum being located at one of said yarn twisting stations;

means for taking up said randomly twisted yarns from each said pneumatic twisting head over one of said traversing drums to form a yarn package;

an electric motor for rotatingly driving said common shaft for rotating said traversing drums;

electrical input means for supplying said motor with alternating electric current; and control means including a cam-actuated switch for varying said electrical input according to a predetermined cycle including a variation of said electrical input sufficient to result in randomly unpredictable inertial resistance of the traversing drum to rotational speed variation, thereby creating randomly unpredictable take up of said yarns to produce non-uniform random twist in said yarns.

13. A method for producing randomly variegated multiple strand twisted yarn in twisting together two or more yarns at a yarn twisting station, comprising:

continuously feeding at least two yarns through at least one rotating hollow spindle;

wrapping the yarns with a binder yarn as the yarns enter and pass through the rotating hollow spindle;

imparting a twist to the yarns by the wrapping by the binder yarn from the rotating hollow spindle;

taking up the wrapped yarns over a traversing drum to form a yarn package;

rotating said traversing drum by driving it with an electric motor powered by alternating electric current; and varying the electrical input to said electric motor according to a predetermined cycle including a variation of said electrical input sufficient to result in randomly unpredictable inertial resistance of the traversing drum to rotational speed variation, thereby creating randomly unpredictable take up of said yarns to produce non-uniform random twist in said yarns.

14. The method of claim 13, wherein the step of wrapping the yarns comprises wrapping the yarns as the yarns enter and pass through a first rotating hollow spindle, passing the yarns through the first rotating hollow spindle, then feeding the yarns to a second rotating hollow spindle and wrapping the yarns as the yarns enter and pass through the second rotating hollow spindle and passing the yarns through the second rotating hollow spindle, said rotating hollow spindles rotating in opposite directions.

15. The method of claim 13, wherein the step of continuously feeding at least two yarns through at least one rotating hollow spindle comprises ensuring that the yarns are sufficiently untensioned to enable a twist to be imparted by the wrapping by the binder yarn from the rotating hollow spindle.

16. A method for producing randomly variegated multiple strand twisted yarn in pneumatically twisting together two or more yarns at a yarn twisting station, comprising:

continuously feeding at least two yarns into a chamber in a pneumatic twisting head;

delivering compressed air to a supply conduit through spaced inlets intermittently and non-simultaneously discontinuing air flow through said spaced inlets to create random air turbulence within said supply conduit;

supplying said randomly turbulent air from said supply conduit through an outlet in said supply conduit to said chamber for randomly twisting together the yarns in said chamber; and taking up said yarns from the twisting head to form a yarn package.

17. An apparatus for producing randomly variegated multiple strand yarn in pneumatically twisting together at least two yarns at a yarn twisting station, comprising:

a pneumatic twisting head having a chamber therein;

means for continuously feeding at least two yarns into said chamber in said pneumatic twisting head;

a supply conduit having spaced inlets into which compressed air is delivered so as to create random air turbulence in said supply conduit, said spaced inlets having means for intermittently and non-simultaneously discontinuing air flow through said spaced inlets into said supply conduit, said supply conduit further having an outlet communicating with said chamber to supply said randomly turbulent air thereinto for randomly twisting together the yarns therein; and means for taking up said randomly twisted yarns to form a yarn package.

* * * * *

UNITED STATES PATENT AND TRADEMARK OFFICE

CERTIFICATE OF CORRECTION

PATENT NO. : 5,673,549

DATED : October 7, 1997

INVENTOR(S) : William A. McNeill

It is certified that error appears in the above-identified patent and that said Letters Patent is hereby corrected as shown below:

Column 1, line 33, delete "itself" and insert - - itself, - -

Column 3, line 62, delete "practice" and insert - - practiced - -

Column 6, line 30, delete "cam actuated" and insert - - cam-actuated - -

Column 7, line 17, delete "binder tarn, the yarns 16" and insert - - binder yarn 102. In a - -

Column 10, line 32, delete "supply conduit said" and insert - - supply conduit to said - -

Signed and Sealed this

Twenty-sixth Day of January, 1999

*Attest:*

*Attesting Officer*

*Acting Commissioner of Patents and Trademarks*